United States Patent [19]

Mason

[11] Patent Number: 4,893,489

[45] Date of Patent: Jan. 16, 1990

[54] DRIVE SYSTEM FOR A BENDING MACHINE

[75] Inventor: Benjamin Mason, Newark, England

[73] Assignee: Caledonian Mining Company Limited, Great Britain

[21] Appl. No.: 170,138

[22] Filed: Mar. 14, 1988

Related U.S. Application Data

[63] Continuation-in-part of Ser. No. 30,872, Mar. 26, 1987, abandoned.

[30] Foreign Application Priority Data

Mar. 27, 1986 [GB] United Kingdom ..... 8607806

[51] Int. Cl.[4] ..... B21D 5/14

[52] U.S. Cl. ..... 72/8; 72/21; 72/19; 72/173

[58] Field of Search ..... 72/7, 9, 12, 8, 21, 72/23, 19, 173, 175

[56] References Cited

U.S. PATENT DOCUMENTS

| | | | |
|---|---|---|---|
| 4,047,411 | 9/1977 | Foster | 72/173 |
| 4,080,815 | 3/1978 | Foster | 72/173 |
| 4,117,702 | 10/1978 | Foster | 72/7 |
| 4,132,099 | 1/1979 | Elsener | 72/175 |
| 4,232,540 | 11/1980 | Cain et al. | 72/173 |
| 4,367,640 | 1/1983 | Heitzman | 72/173 |

*Primary Examiner*—Daniel C. Crane

*Attorney, Agent, or Firm*—Wood, Herron & Evans

[57] ABSTRACT

An improved bending machine with three rollers which may be driven at different speeds and/or with differing torques. A control system receives signals indicative of the position and speed of rotation of one or more of the rollers. The control system is connected to a mechanism for adjusting the position, rotational speed and torque of at least one roller so that commands can be given to vary these parameters. Thus, the machine can be readily and accurately adjusted to produce bends of differing dimension in a strip workpiece.

21 Claims, 2 Drawing Sheets

DRIVE SYSTEM FOR A BENDING MACHINE

This application is a continuation-in-part of application Ser. No. 030,872, filed Mar. 26, 1987, now abandoned.

BACKGROUND OF THE INVENTION

The present invention relates to apparatus for and a method of bending strip metal material such as I section beams and U section beams or other formed sections.

In order to bend such sections it is conventional to provide three or more rolls which straddle the feed path of the material to be bent. The first roll normally has a fixed axis on one side of the path, the next or second along the path is on the other side, whilst the third roll is on the same side of the path as the first, the second and third rolls have axes which are adjustable with respect to the bending path. Other rolls may also be provided.

The axes of the rollers are essentially parallel (or sometimes on an angle in order to generate a cone shape) to each other, and are arranged in approximately a triangular pattern so that a strip or sheet like workpiece passed between them is bent in to a curved shape. Such a bending machine will hereafter be referred to as a bending machine of the type described.

A conventional roll bending machine is driven by a single motor and/or gearbox. One or more of the rollers may be driven directly or by shafts, gears, chains etc. and consequently all driven rollers rotate at the same speed or fixed ratio of speeds. One or more rollers may not be driven at all and allowed to freewheel.

When bending thin sections or large radius curves this does not present a problem but with small radii and thicker sections the different relative speeds of the outside and inside of the curve results in either slip, distortion of the section or overloading of the gearbox components. When bending large sections this problem is kept to a minimum by passing the workpiece backwards and forwards several times making progressive reductions in radii and permitting some slip on one or more of the rollers.

If a small radii is attempted in a single pass of the workpiece, the internal forces induced in the workpiece will cause severe and unacceptable deformation. On the other hand, if one or more of the rollers is allowed to freewheel to eliminate slip, then the driven roller(s) will also slip and/or distort the section.

SUMMARY OF THE INVENTION

The general object of the invention is to eliminate or substantially to eliminate these problems and to enable a bending machine to be readily adjusted accurately to produce bends of differing dimensions.

A bending machine of the type described in accordance with the invention has for one or more of its rollers (three or more) a means for ascertaining the position of the or each roller, means for adjusting that position, means for measuring the speed of rotation of the or each roller, means for adjusting that speed (and preferably) means for measuring the torque applied to the or each roller and means for adjusting that torque, signals from the means for measuring the position, speed (and preferably) applied torque on the rollers being fed to a control system unit which in turn is connected to the means for adjusting the position, speed and applied torque of the or each roller so that commands may be given to vary these parameters.

Thus complete control over each of the parameters is maintained and as we have discovered that it is these parameters which effect the proper bending of the arch to a determined radius, the apparatus may be readily adjusted for any desired arch within limits by giving the control unit the necessary instructions.

For example, the section to be bent should be driven forward at a reasonable speed with sufficient torque force being applied through the rollers to achieve bending without the rollers slipping and to enable the desired internal force to be generated in the section.

It will be appreciated that normally the rollers will be driven at different speeds and/or with differing torques.

However with one control system unit on each motor it is possible to control either motor pressure or motor speed, but not both simultaneously.

The rollers will normally be driven either by independent hydraulic, electrical or pneumatic motors or by or by variable speed drives.

DETAILED DESCRIPTION OF THE PREFERRED EMBODIMENT

Figure 1:
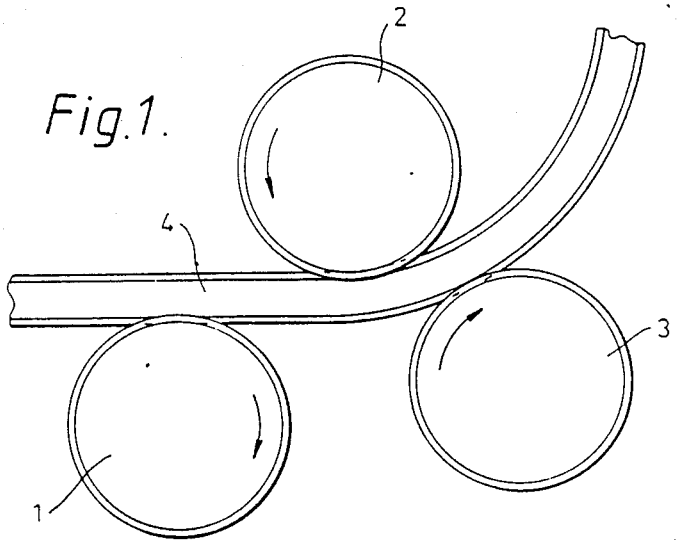
FIG. 1 is a diagrammatic view of a three roll bending machine of the type described showing an I section beam being bent to form a colliery arch.

Referring to FIG. 1 a typical three roll arch bending machine of the type described is illustrated but the invention is in no way restricted to such a particular layout.

Three rolls 1, 2 and 3 are located in a triangular position with an I section beam 4 moved between the rolls in the direction of the arrow. The axes of the rolls are movable relative to each other so that they can be positioned to achieve the desired radius of curvature of the bent section.

Figure 2:
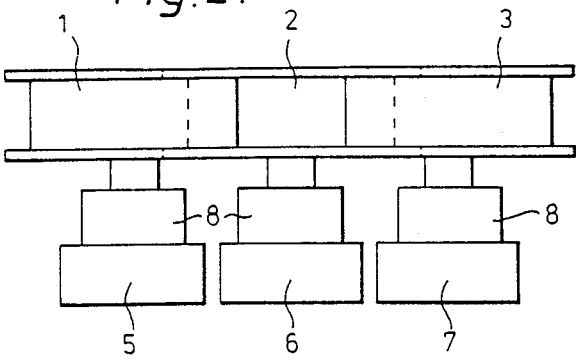
FIG. 2 is a side elevation of the apparatus shown in FIG. 1.

As can be seen from FIG. 2 each of the three rolls is driven by a separate motor 5, 6 and 7 through gears 8. As each roll has its own drive motor the speed and torque applied to each roll may differ and the relevant speeds may be adjusted during bending of the I section beam.

Figure 3:
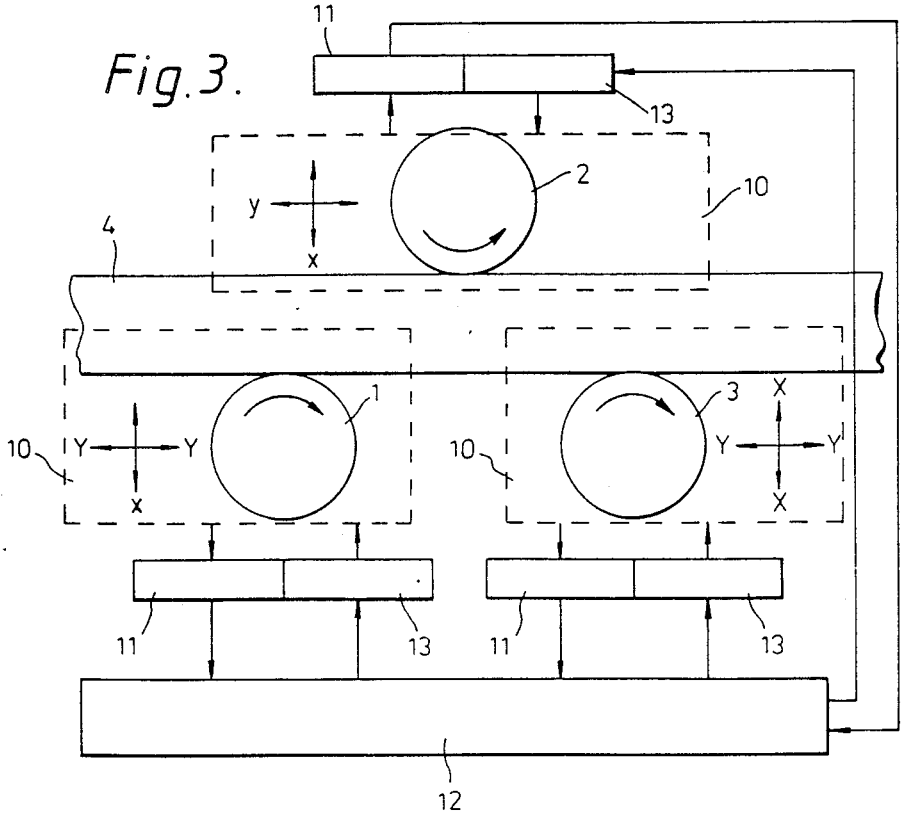

As is illustrated in FIG. 3 the position of each of the rolls 1, 2 and 3 is adjustable by means of a positioning actuator generally indicated at 10 in the direction both of the axis x and the axis y. The position of each roll at any one time can be measured by a measuring device generally indicated at 11.

The speed of rotation of each roll can be adjusted by a rotation actuator (not shown) which in effect can adjust the speed of rotation of each roll through the drive motors 5, 6 and 7 and gearing 8. The instant speed of each roll is measured by a measuring device 11.

Finally the torque applied to each roll is both adjustable and measurable.

Signals from the measuring units 11 of both the position in the x and y directions, the rotational speed and the torque, is fed to a control unit 12. The control unit in accordance with instructions which it has received for some particular section and some particular desired radius then issues instructions for alterations to the position, speed and torque of each of the three rolls to adjustment means 13 so as to achieve the desired curvature. This control system continues to operate during the formation of the bend in the section.

It will be appreciated that for example the torque applied to the various rolls may differ for example for one power unit, roll 3 could have two units of torque applied to it, roll 2 could have no torque applied and roll 1 could have minus one unit of torque. This would then give the effect of stretching the outer curved face of the section helping to prevent the tendency to crumple and help to prevent elongation of any holes which may be present in the web of the I section along the central zone where deformation tends to occur.

Figure 4:
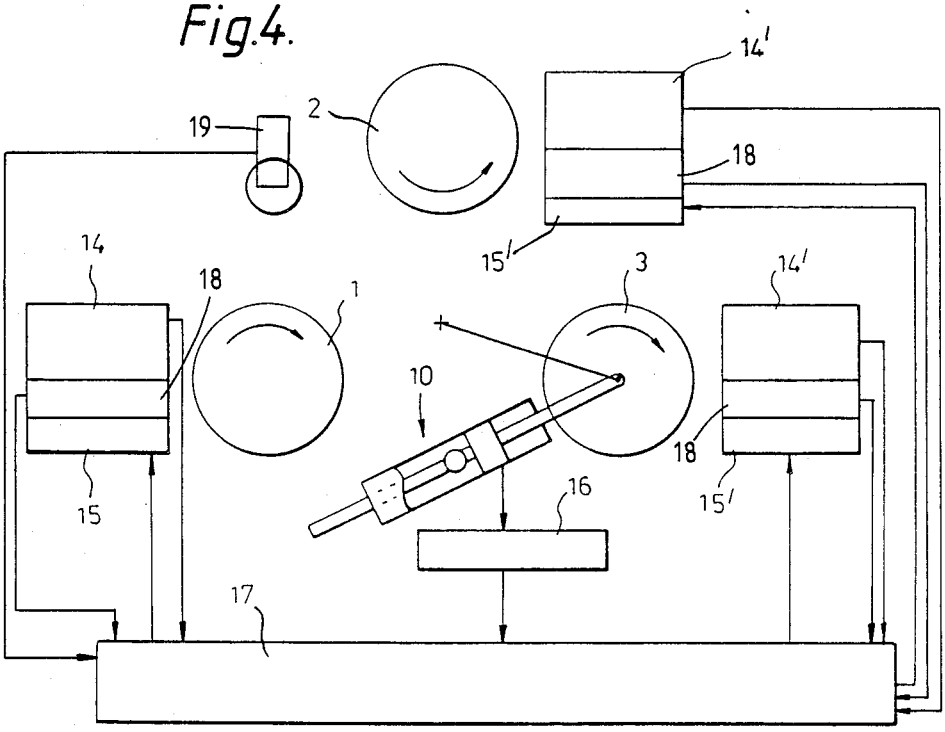
FIG. 3 is a schematic view of the apparatus shown in FIGS. 1 and 2 illustrating the control system and FIG. 4 is an example of one particular embodiment of a bending machine incorporating the principles generally illustrated in FIG. 3.

In the machine exemplified in FIG. 4, the rolls are driven by hydraulic motors. Roll 1 is provided with a pressure measuring device 14 and a proportional valve pressure control 15 for control over the fluid pressure applied to the motor so that the torque may be varied. The position of the proportional valve is set by the control device 17 and the device 14 for measuring pressure is then linked to the control device 17 to measure the achieved pressure. The speed measuring device 18 measures the achieved speed and is also linked to the control device 17. Similar controls (not shown) are provided for the rolls 2 and 3 but the roll 3 is also provided with a hydraulic piston and cylinder device generally indicated at 10 designed to alter the position of roll 3 in both the x and y direction. This device is also linked to a position measuring device 16 giving signals to the control unit 17. A fluid pressure measuring device 14' is also provided for the fluid flow to the hydraulic motor for rolls 2 and 3 and the output from this measuring device is fed to control unit 17. A flow control proportion valve 15' receives instructions from the control unit 17 so that the speed of rotation of rolls 2 and 3 may be adjusted. A position measuring device 19 is also connected to the control device 17 to measure the progress of the material through the machine.

It will thus be appreciated that the control unit 17 issues precalculated instructions for alteration of the torques applied to rollers 1 and 2, the rotational speed of roll 3 and the position of roll 3, to generate the desired profile. At the same time, the controller 17 monitors the achieved speed of all rolls with devices 18, the achieved pressures with the pressure measuring devices 14, the achieved progress along the workpiece with position measuring device 19, and the achieved roll 3 position with device 16, and will automatically modify the instructions to achieve the correct profile at the correct speed. In this way the overall control system can compensate automatically for any process variations.

The control device 17 can also stop the bending process at any desired place for cutting off pieces of profiled workpieces as they pass out of the machine. This is achieved by the control device 17 bringing the desired speed down to zero in a controlled way and then using the measurements from the position measuring device 19 to control the torques to the rolls with devices 15 to correct the position. It will then continue to control these torques to maintain the position whilst cutting is in progress.

What I claim is:

1. A bending machine for bending a strip workpiece from a linear infeed configuration to a curved outfeed configuration, said machine comprising at least three rollers oriented in a generally triangular pattern through which said strip workpiece is passed, means for ascertaining the position of one of said rollers, bi-directional means for adjusting that position, said bi-directional means permitting the roller position to be altered in two directions which are perpendicular one relative to the other, means for measuring the speed of rotation of one of said rollers, means for adjusting that speed, means for measuring the torque applied to one of said rollers, and a control system unit to which signals are fed from said position ascertaining means and from said speed measuring means, said control system unit being connected to said bi-directional means and to said speed adjusting means for adjusting the position and speed for the affected roller, a signal from said means for measuring the applied torque on the affected roller also being fed to said control system unit, said control system unit being connected to said means for adjusting the applied torque of that affected roller all so that commands may be given to vary these parameters in order to enhance the desired bending of a linear infeed workpiece into a curved outfeed workpiece.

2. A machine as claimed in claim 1 comprising means to drive said roller at different speeds.

3. A machine as claimed in claim 1 comprising drive means comprising an independent hydraulic motor connected to each of said rollers.

4. A machine as claimed in claim 1 comprising drive means comprising an independent electrical motor connected to each of said rollers.

5. A machine as claimed in claim 1 comprising drive means comprising an independent pneumatic motor connected to each of said rollers.

6. A machine as claimed in claim 1 comprising variable speed drives connected to each of said rollers.

7. A machine as claimed in claim 1, said speed adjusting means comprising a proportional valve control unit.

8. A machine as claimed in claim 1, said speed measuring means comprising a pressure measuring device.

9. A machine as claimed in claim 1 comprising means for measuring the position of the strip workpiece relative to said roller.

10. A bending machine for bending a strip workpiece from a linear infeed configuration to a curved outfeed configuration, said machine comprising at least three rollers oriented in a generally triangular pattern through which said workpiece is passed, at lest one of said rollers comprising, means for ascertaining the position of said roller, bi-directional means for adjusting that roller position, said bi-directional means permitting said roller position to be altered in both of two directional which are perpendicular one relative to the other, means for measuring the speed of rotation of said roller, means for adjusting that speed, means for measuring the torque applied on said roller, means for adjusting that torque, and a control system unit to which signals are fed from said position ascertaining means, from said speed measuring means, and from said torque measuring means, said control system unit being connected to said bi-directional means, said speed adjusting means, and said torque adjusting means so that commands may be given to vary these parameters in order to enhance the desired bending of a linear infeed workpiece into a curved outfeed workpiece.

11. A machine as claimed in claim 10 comprising means to drive said roller at different speeds.

12. A machine as claimed in claim 10 comprising means to drive said roller with differing torques.

13. A machine as claimed in claim 10 comprising drive means comprising an independent hydraulic motors connected to each of said rollers.

14. A machine as claimed in claim 10 comprising drive means comprising an independent electrical motor connected to each of said rollers.

15. A machine as claimed in claim 10 comprising drive means comprising an independent pneumatic motor connected to each of said rollers.

16. A machine as claimed in claim 10 comprising variable speed drives connected to each of said rollers.

17. A machine as claimed in claim 10, said speed adjusting means comprising a proportional valve control unit.

18. A machine as claimed in claim 10, said torque adjusting means comprising a proportional valve control unit.

19. A machine as claimed in claim 10, said speed measuring means comprising a pressure measuring device.

20. A machine as claimed in claim 10, said torque measuring means comprising a pressure measuring device.

21. A machine as claimed in claim 10 comprising means for measuring the position of the strip workpiece relative to said roller.

* * * * *

UNITED STATES PATENT AND TRADEMARK OFFICE

CERTIFICATE OF CORRECTION

PATENT NO. : 4,893,489

DATED : January 16, 1990

INVENTOR(S) : Benjamin Mason

It is certified that error appears in the above-identified patent and that said Letters Patent is hereby corrected as shown below:

Column 4, line 23 delete "for" and insert --of--

Column 4, line 64 delete "directional" and insert --directions--

Signed and Sealed this

Ninth Day of July, 1991

*Attest:*

HARRY F. MANBECK, JR.

*Attesting Officer*

*Commissioner of Patents and Trademarks*